US007128045B2

(12) United States Patent
Roelofs

(10) Patent No.: US 7,128,045 B2
(45) Date of Patent: Oct. 31, 2006

(54) COMBUSTION ENGINE

(76) Inventor: Johannes Roelofs, Wigboldinck 52, NL-7683 WV, Den Ham (NL)

( * ) Notice: Subject to any disclaimer, the term of this patent is extended or adjusted under 35 U.S.C. 154(b) by 0 days.

(21) Appl. No.: 10/503,612

(22) PCT Filed: Feb. 3, 2003

(86) PCT No.: PCT/NL03/00072

§ 371 (c)(1),
(2), (4) Date: Jan. 6, 2005

(87) PCT Pub. No.: WO03/067031

PCT Pub. Date: Aug. 14, 2003

(65) Prior Publication Data

US 2005/0115536 A1 Jun. 2, 2005

(30) Foreign Application Priority Data

Feb. 5, 2002 (NL) ..... 1019904

(51) Int. Cl.
*F02B 53/04* (2006.01)
*F01C 1/00* (2006.01)
*F01C 1/344* (2006.01)
*F04C 18/00* (2006.01)

(52) U.S. Cl. ..... 123/229; 123/231; 418/241

(58) Field of Classification Search ..... 123/227, 123/229, 231; 418/241, 137–138; *F01C 1/344*
See application file for complete search history.

(56) References Cited

U.S. PATENT DOCUMENTS 1,221,333 A * 4/1917 Killman ..... 418/241
3,323,501 A * 6/1967 Balve ..... 418/241
3,872,840 A * 3/1975 Adragna ..... 123/229
3,952,709 A * 4/1976 Riddel ..... 123/231
4,451,219 A * 5/1984 Kurherr ..... 418/138
6,070,565 A * 6/2000 Miniere ..... 123/231

FOREIGN PATENT DOCUMENTS

| | | | |
|---|---|---|---|
| DE | 30 11 399 A1 | * | 10/1981 |
| EP | 775814 A1 | * | 5/1997 |
| FR | 826 534 | * | 4/1938 |
| FR | 1 298 370 | * | 7/1962 |
| GB | 346 405 | * | 4/1931 |

* cited by examiner

*Primary Examiner*—Thai-Ba Trieu
(74) *Attorney, Agent, or Firm*—Jensen & Puntigam PS

(57) ABSTRACT

The invention relates to a combustion engine (1) having a housing (2) with a chamber (3). A rotor (4) is arranged herein which is provided with a number of vanes (5A, 5B, 6A, 6B) which divide the chamber into a number of compartments (3A, 3B, 3C, 3D). Each of the compartments is intended for performing at least one of the following functions: a) drawing in and/or compressing gas required for the combustion; b) bringing the fuel to combustion; c) producing work; and d) discharging combustion gases. A first pair of vanes (5A, 5B) is mounted rotatably on a first rotation axis (5). A second pair of vanes (6A, 6B) is mounted rotatably on a second rotation axis (6). The rotation axes are arranged eccentrically in the chamber (3). The rotary engine has the characteristic that the vanes in each pair (5A, 5B; 6A, 6B) are rotatable independently of each other.

16 Claims, 8 Drawing Sheets

COMBUSTION ENGINE

BACKGROUND OF THE INVENTION

The present invention relates to a combustion engine, comprising a housing with a chamber, In which is arranged a rotor which is provided with a number of vanes which extend in radial direction to the wall of the chamber and which divide the chamber into a number of compartments, wherein each of the compartments is intended for performing at least one of the following functions: a) drawing in and/or compressing gas required for the combustion; b) bringing the fuel to combustion; c) producing work; and d) discharging combustion gases, wherein a first pair of vanes is mounted rotatably on a first rotation axis and wherein a second pair of vanes is mounted rotatably on a second rotation axis, which rotation axes are arranged eccentrically in the chamber.

Such an internal combustion engine is known in the field as a rotary engine. The rotary engine has a number of advantages compared to the traditional internal combustion engine, the "Otto engine". By replacing the piston with a rotor, the rotary engine can in principle suffice with just one chamber. The rotary engine now has an inherently balanced construction, whereby added balance weights, as are usual in the Otto engine, can be omitted. The rotary engine therefore has a minimum of components, which increases the reliability and reduces the production costs.

An example of a rotary engine is described in the American patent specification U.S. Pat. No. 6,070,565. In the known rotary engine the vanes are coupled in pairs by means of a yoke which translates round a fixed point. The translating movement of the vanes in the rotor is not hereby smooth since the vanes briefly come to a standstill each time the movement of the yoke is reversed. This results in friction losses which adversely affect the efficiency of the rotary engine. The jolting movement also generates extra vibrations. The maximum rotation speed is furthermore limited by this construction.

The invention has for its object to provide a rotary engine of the type stated in the preamble with an improved construction and a higher efficiency. The rotary engine according to the invention has the feature for this purpose that the vanes in each pair are independently rotateable relative to each other. The independently rotatable vanes have the advantage of always making a smooth movement at a practically constant angular speed. The rotary engine hereby has low vibration and undergoes relatively low acceleration and deceleration forces, which contributes toward a higher efficiency as well as a greater comfort at a lower weight.

According to a first preferred embodiment of the combustion engine according to the invention, each of the vanes in the first pair (5A, 5B) is provided with a protruding portion for mounting on the rotation axis 5. According to a second preferred embodiment of the combustion engine according to the invention, each of the vanes in the second pair (6A, 6B) is provided with a recess with a protruding portion on either side for mounting on the rotation axis 6. Each protruding portion is preferably provided with a bearing which is mounted round the rotation axis. This results in an extremely stable construction, also at high rotation speeds.

BRIEF SUMMARY OF THE INVENTION

According to a practical preferred embodiment, the chamber is assembled from three cylinders, the axes of which run substantially parallel to each other. The cross-section of a first part of the chamber preferably takes the form of a first circle with the first rotation axis as centre and a radius which is approximately equal to the radial dimensions of the largest of the associated vanes. The cross-section of a second part of the chamber preferably takes the form of a second circle with the second rotation axis as centre and a radius which is approximately equal to the radial dimensions of the largest of the associated vanes. By varying the position of the rotation axes and the length of the vanes, the volumes of the compartments can be optimally adjusted, and therewith also the ratio between the "intake stroke" compartment and the "power stroke" compartment. As a consequence hereof a higher efficiency can be achieved at a lower exhaust gas temperature and a lower exhaust gas pressure, which causes a low thermal and acoustic environmental impact.

According to a further practical preferred embodiment the radius of the second circle is larger than the radius of the first circle, which results in optimal performance of the combustion engine.

In order to complete the design of the practical preferred embodiments, the cross-section of a third part of the chamber preferably takes the form of a third circle which is situated between the first and the second circle.

According to a following preferred embodiment, the rotor has a number of recesses for the purpose of forming a corresponding number of compartments for bringing the fuel to combustion. The known rotary engine always has one recess on two opposite sides. According to the invention a plurality of recesses is arranged on both sides of the rotor. By varying the number of recesses that are in use, the engine power can be brought from partial load to full load in stepwise manner, and vice versa. It is generally the case that a larger number of recesses enables a more refined control of the engine power. This also results in a higher efficiency and cleaner exhaust gases. Technical possibilities and cost considerations will however limit the maximum number of recesses in practice. The recesses are arranged in two opposite rows, so that combustion can take place in the engine and work can be produced twice per rotation. The form of the recesses is preferably cup-shaped or groove-shaped. According to a further embodiment, the combustion engine is adapted for injection of fuel directly into the recesses. By choosing relatively small volumes for the recesses, the direct injection is active over the whole speed range. The small volumes of the recesses facilitate achieving the desired mixing ratio of air and fuel, whereby pump losses can be reduced even further than is the case in a directly injected Otto engine. In a particularly efficient preferred embodiment the combustion engine is adapted to control the engine power by varying the number of recesses to be injected with fuel.

In a particularly elegant embodiment the combustion engine operates according to the principle of self-ignition. An ignition mechanism is now unnecessary.

BRIEF DESCRIPTION OF THE DRAWINGS

The invention will now be discussed in more detail with reference to drawings of a preferred embodiment, in which.

DETAILED DESCRIPTION OF THE PREFERRED EMBODIMENTS

Figure 1:
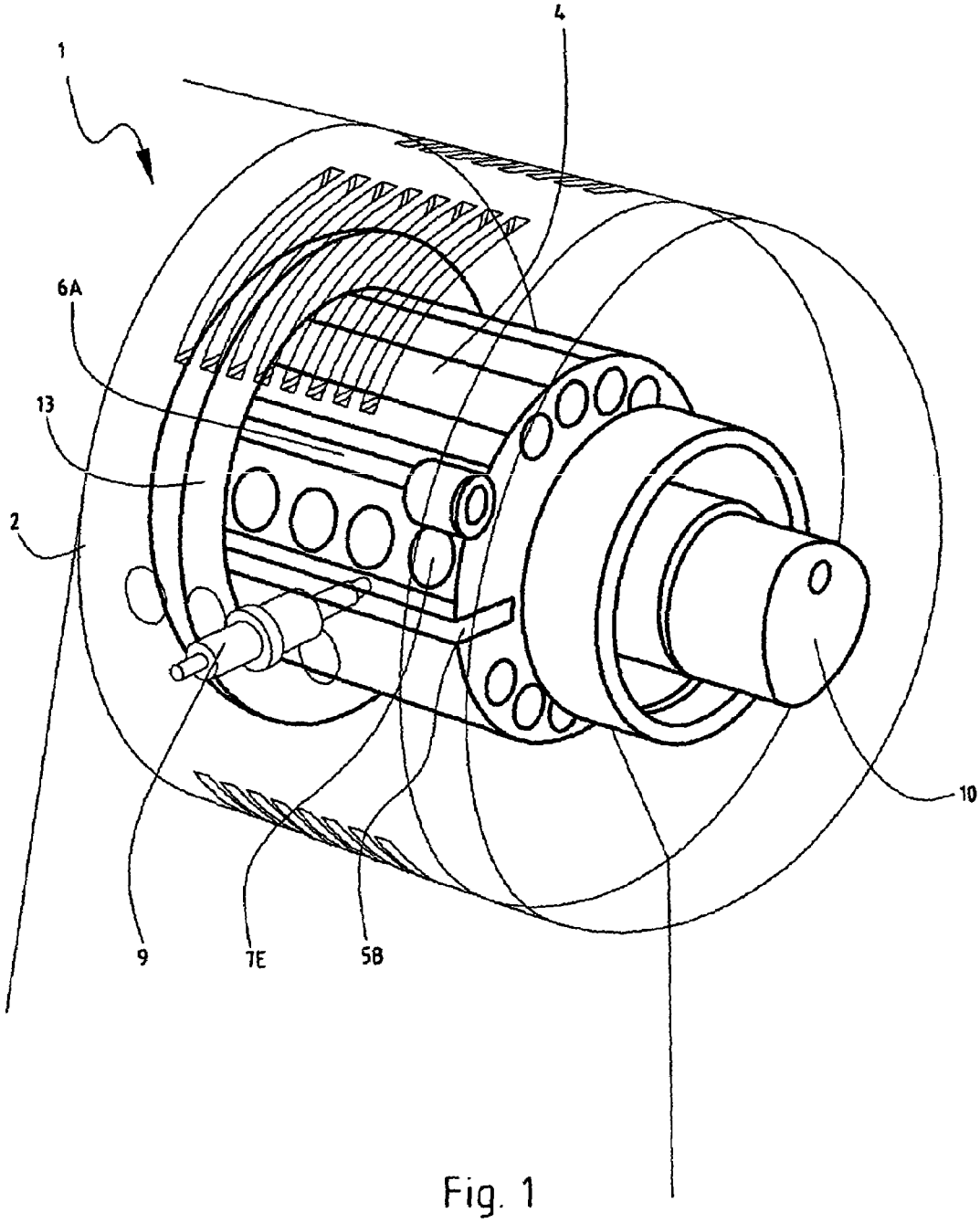
FIG. 1 shows a schematic view of a preferred embodiment of the combustion engine according to the invention.

FIG. 1 shows a schematic view of a preferred embodiment of combustion engine 1 according to the invention. Combustion engine 1 has a housing 2, in which is situated a space or chamber 3. Arranged in chamber 3 is a rotor 4, on which are mounted vanes or blades 5A, 5B, 6A, 6B. The four vanes divide the chamber into a number of compartments. Housing 2, chamber 3 and rotor 4 have a general cylindrical shape.

Rotor 4 has a number of recesses 7A–H for receiving fuel. The recesses are arranged on either side of the rotor and can take different forms. The form is generally cup-shaped or groove-shaped. An example of a cup shape is a hemisphere or a bowl with an elliptic section resembling half an egg. An example of a groove-shaped form is a half-cylinder. Shown in FIG. 1 by way of illustration are hemispherical recesses 7A–D. The number of recesses 7 amounts to two or more per side and depends on the engine capacity. For illustrative purposes, it is expected that a number of between four and ten per side will suffice for an engine capacity of 100 cc.

Figure 5:
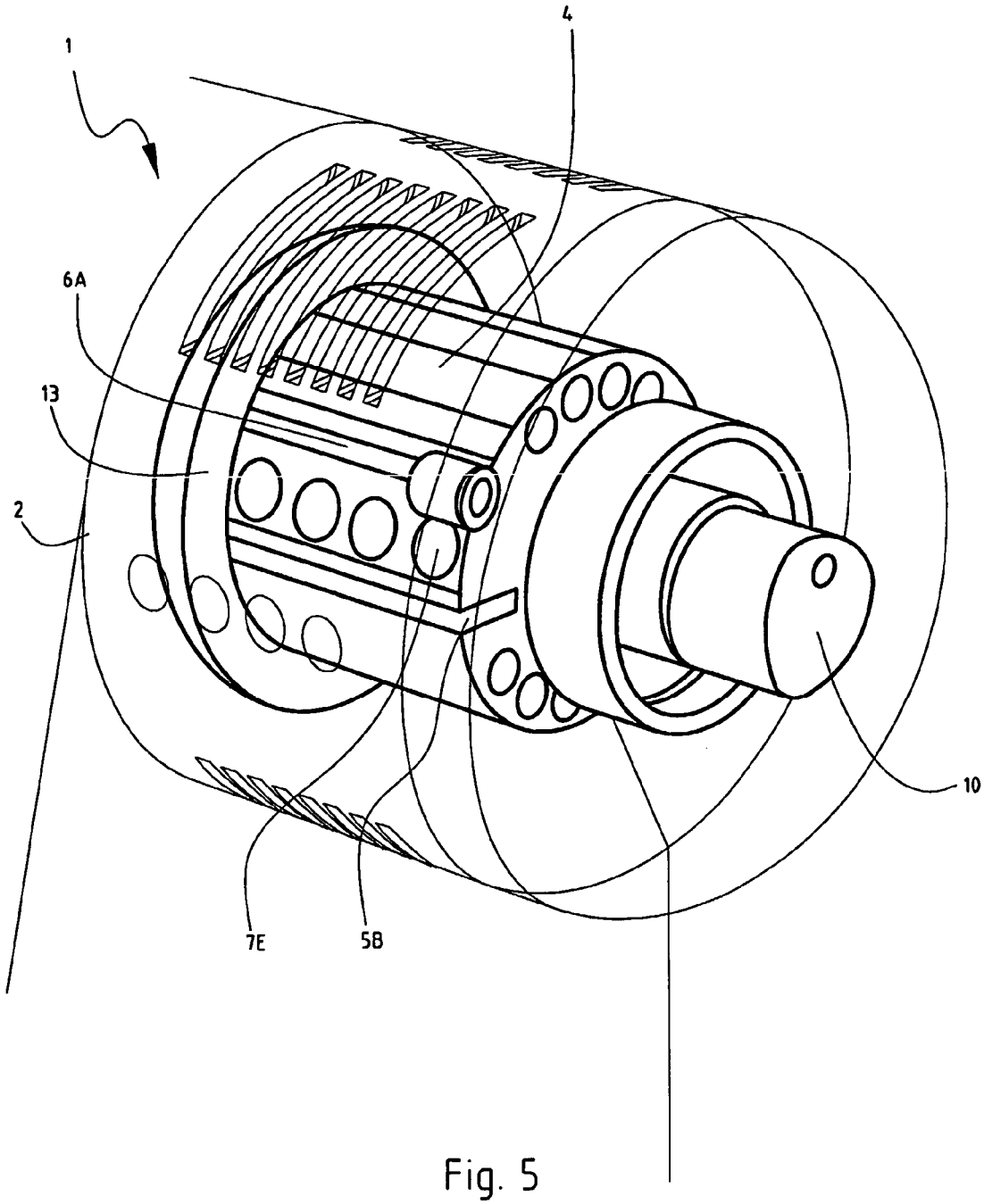
FIG. 5 shows a schematic view of a second preferred embodiment of the combustion engine according to the invention without ignition mechanism.

On the inside of housing 2 are situated means for metered supply of fuel. These fuel dosing means preferably comprise fuel injectors 8 which are adapted for direct injection. Arranged close to fuel injectors 8 is an ignition mechanism 9, for instance a spark plug, for igniting the fuel. Ignition mechanism 9 is not necessary, since the engine can also operate in accordance with the principle of self-ignition. FIG. 5 shows by way of illustration a second embodiment of a rotary engine according to the invention without ignition mechanism.

Figure 2:
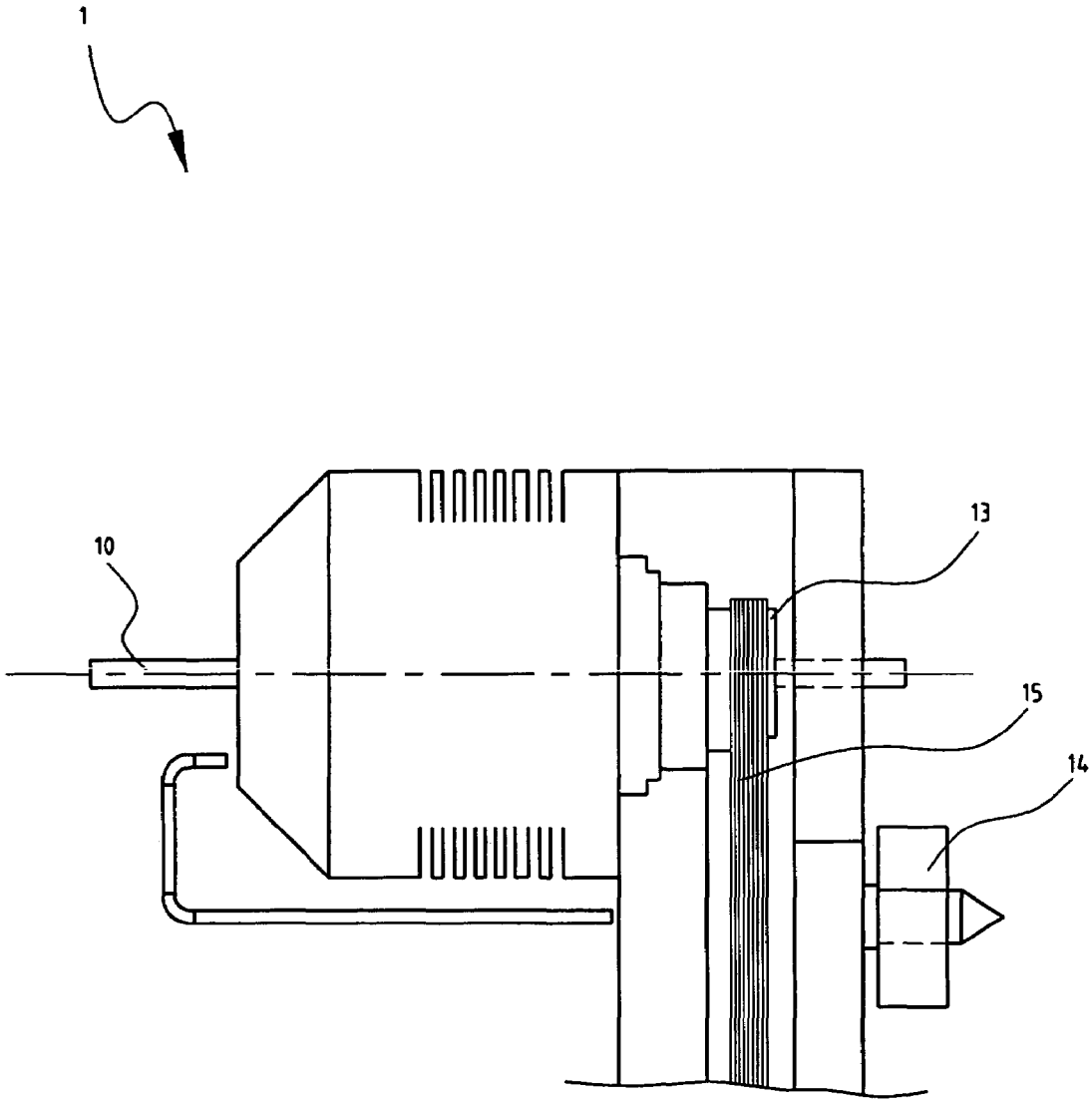
FIG. 2 shows a schematic front view of the combustion engine of FIG. 1.

FIG. 2 shows combustion engine 1 in schematic front view. Combustion engine 1 has a shaft 10 for fixing the engine to the real world. The work produced by the engine can be transferred by coupling to one of the many transmission mechanisms known in the field. In the shown preferred embodiment the rotor 4 is coupled for this purpose to a side piece 13 for driving a toothed wheel 14 by means of a drive belt 15.

FIGS. 3A–3D show a schematic cross-section through combustion engine 1 with the rotor respectively in a first, second, third and fourth position. Rotor 4 is provided with a first pair of vanes 5A, 5B which are rotatable about a rotation axis 5. A second pair of vanes 6A, 6B is rotatable about a second rotation axis 6. The first rotation axis 5 and second rotation axis 6 run substantially parallel to each other at some mutual distance and extend in the line of chamber 3. Both rotation axes are arranged eccentrically in the chamber. The two vanes 5A, 5B in the first pair are rotatable independently of each other, as are two vanes 6A, 6B in the second pair. This will be further elucidated with reference to FIG. 4. Situated on the outer ends of the vanes are hinges respectively 15A, 15B and 16A, 16B which give the vanes sufficient freedom of movement relative to rotor 4.

A first important function of the vanes is to divide chamber 3 into compartments. For this purpose the vanes follow the wall of chamber 3 during rotation. Each vane is provided on its outer ends, in both radial and axial direction, with a suitable sealing material. Some clearance is utilized here between the wall of the chamber and the edge of the seal in order to allow the rotation of the rotor to proceed without hindrance. An example of a suitable sealing material is ceramic material. A second important function of the vanes is power transmission. In this respect the first pair of vanes 5A, 5B are also designated as compression vanes and the second pair of vanes 6A, 6B are designated working vanes.

The form of chamber 3 is generally of a non-round cross-section. Chamber 3 is assembled from three eccentric cylinders which partly overlap each other. The cross-section is made up of three eccentric circles. In FIGS. 3A–3D the left-hand part of chamber 3 takes the form of (a part) of a circle L with axis 5 as centre and a radius which is approximately equal to the radial dimensions of vanes 5A and 5B. The right-hand part of chamber 3 takes the form of (a part) of a circle R with axis 6 as centre and a radius which is approximately equal to the radial dimensions of vanes 6A and 6B. The central part of chamber 3 has the form of (a part) of a circle M. The ratio of the volumes of the associated cylinders L and R determines the performance of the combustion engine. These volumes can be adjusted by choosing the position of axes 5 and 6 and through the choice of the radial dimensions of the vanes. The optimal volume ratio is a function of the compression ratio. For example, at a compression ratio of 1:18, which is usual for a diesel engine, the volume ratio is approximately $\text{volume}_L:\text{volume}_R=1:3$.

Rotor 4 has a substantially round cross-section. The diameter hereof is substantially equal to the diameter of the circle forming the central part M, in this embodiment this is the smallest diameter of chamber 3.

On the underside of the chamber are situated an intake 11 for air and an exhaust 12 for combustion gases.

During rotation the chamber is divided into compartments, the volume of which changes. The number of compartments varies and is three or four, depending on the position of the rotor. In this manner the function of the intake stroke, the compression stroke, power stroke and the exhaust stroke of the combustion engine is realized, which will be elucidated hereinbelow.

The combustion engine according to the invention operates as follows.

Figure 3A:
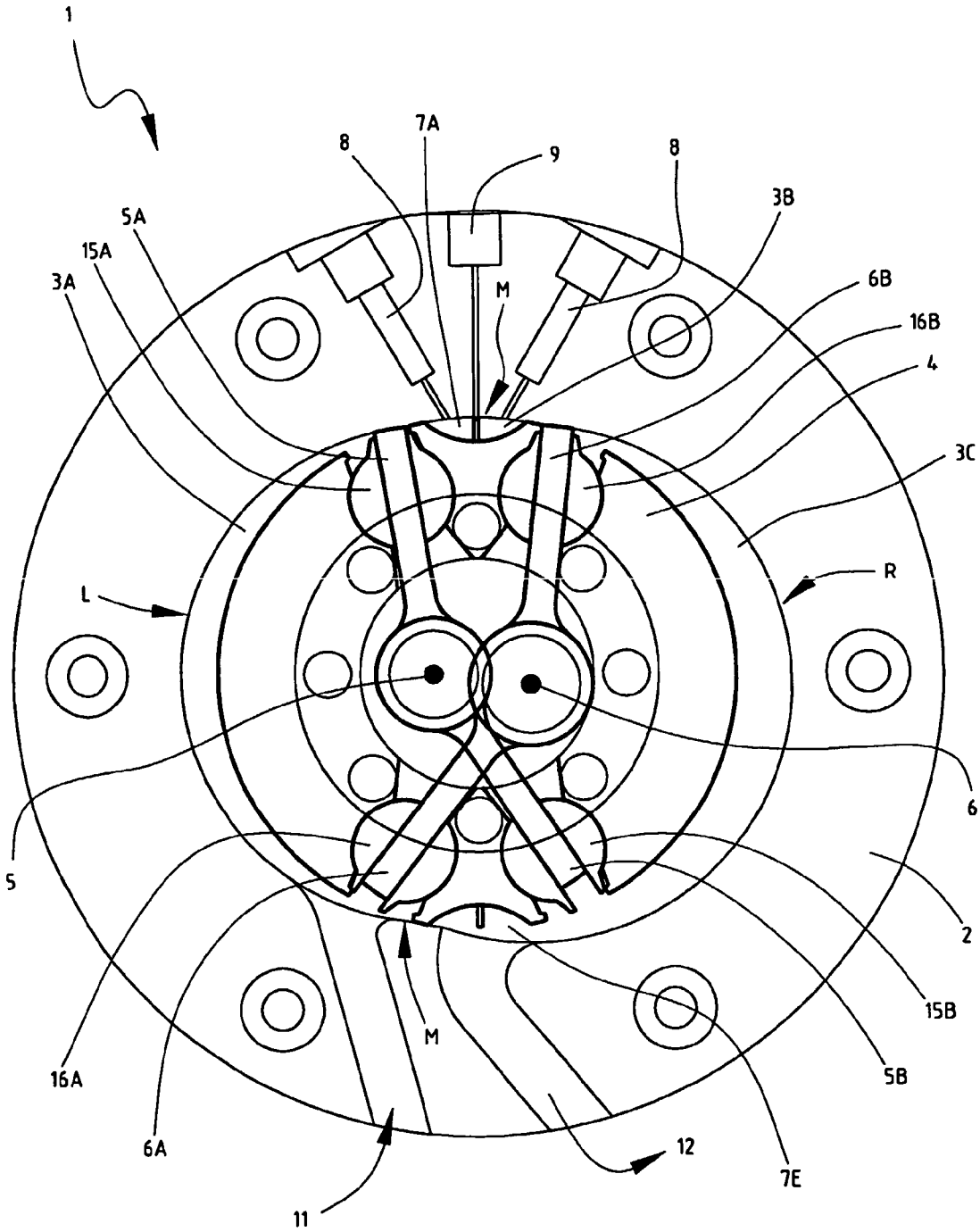
FIG. 3A shows schematically a cross-section through the combustion engine of FIG. 1 in top view, with the rotor in a first position.

FIG. 3A shows the rotor in a first position. The chamber is now divided into three compartments, respectively 3A–3C. In compartment 3A air is drawn in by means of intake 11. The air present in compartment 3B is compressed to the the maximum in recess 7A and in all compartments located in the same row. Fuel injectors 8 now inject fuel into one or more recesses (depending on the desired power), so that a combustible mixture is created per injected recess. If the fuel is petrol, this preferably takes place in a ratio of 1 part fuel to 14 parts air. The mixture is brought to explosion by means of spark plug 9. In compartment 3C expansion takes place after a preceding combustion and work is produced.

Figure 3B:
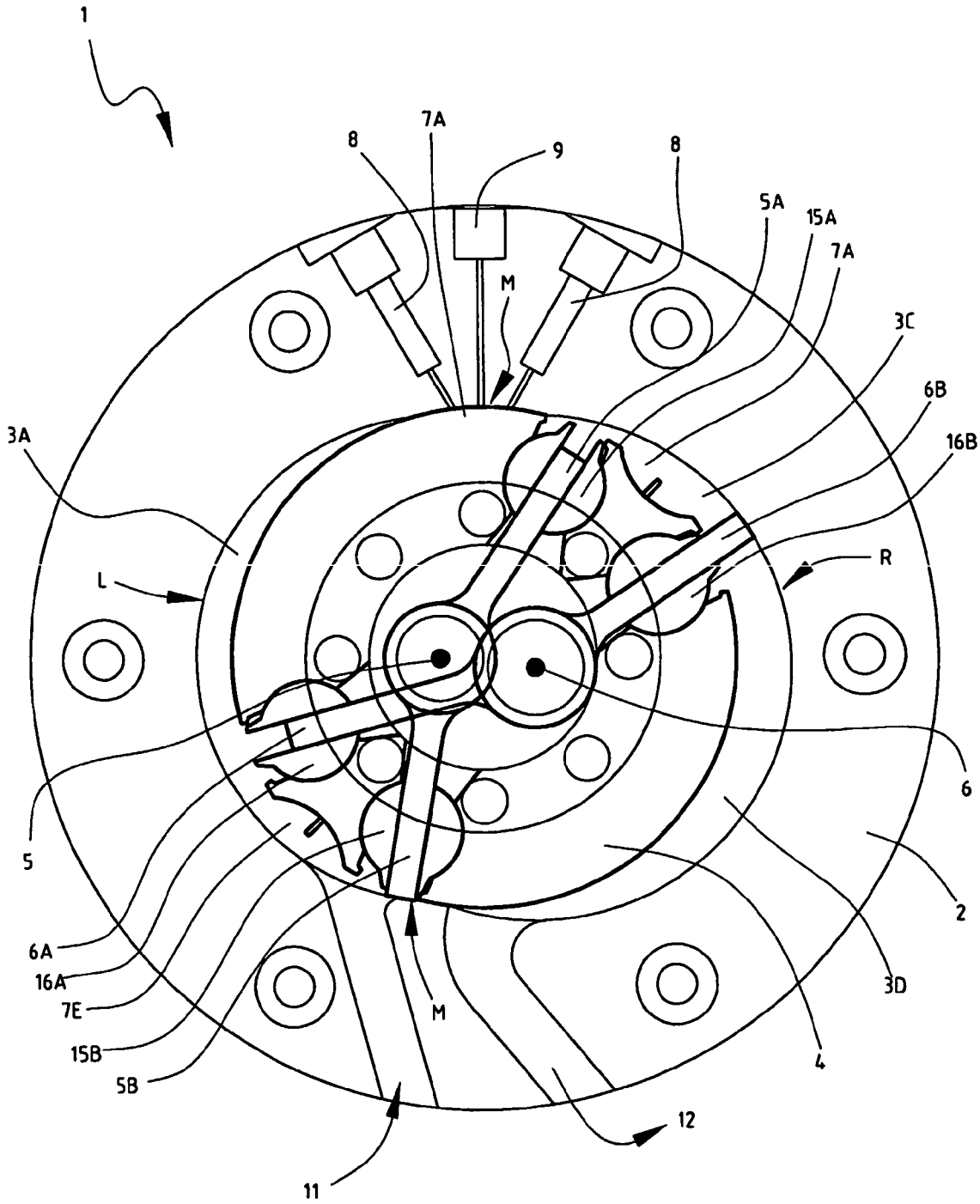
FIG. 3B shows schematically a cross-section through the combustion engine of FIG. 1 in top view, with the rotor in a second position.

FIG. 3B shows rotor 4 in a second position, in which the rotor is rotated approximately 45 degrees in clockwise direction. The chamber is still divided into three compartments, which are now designated 3A, 3C and 3D respectively. The volume of compartment 3A has increased further due to air being drawn in by means of intake 11. After the combustion compartment 3B of FIG. 3A becomes compartment 3C which, as a result hereof, expands and produces work. The volume of compartment 3D decreases further during exhausting of the combustion gases present herein by means of exhaust 12.

Figure 3C:
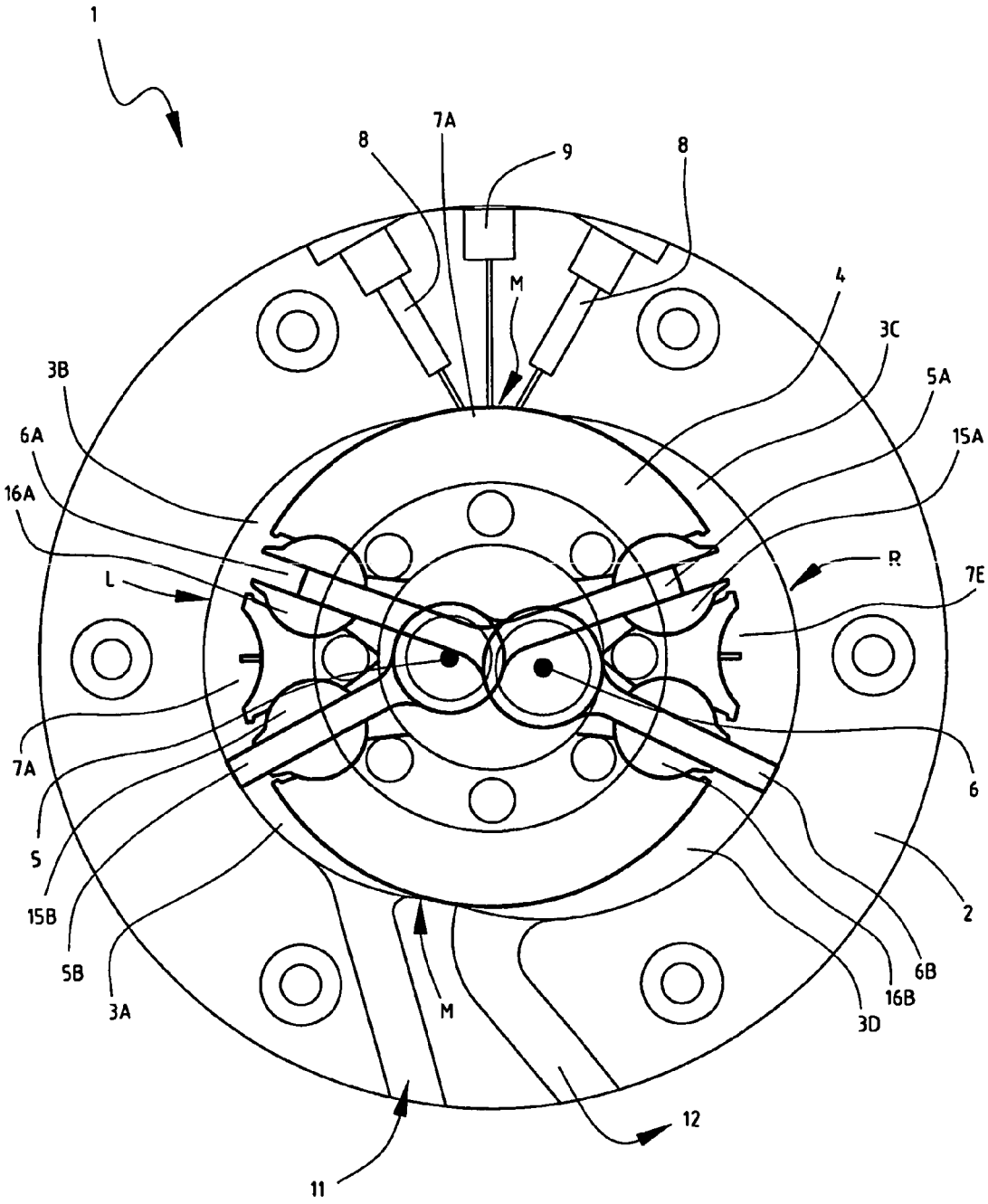
FIG. 3C shows schematically a cross-section through the combustion engine of FIG. 1 in top view, with the rotor in a third position.

FIG. 3C shows rotor 4 in a third position, in which the rotor has again been rotated approximately 45 degrees further in clockwise direction. The chamber is now divided into four compartments, 3A–3D respectively. In compartment 3A new air is drawn in by means of intake 11. The air present in compartment 3B is compressed. In compartment 3C expansion still takes place after combustion, and work is produced. The combustion gases in compartment 3D are further discharged by means of exhaust 12.

Figure 3D:
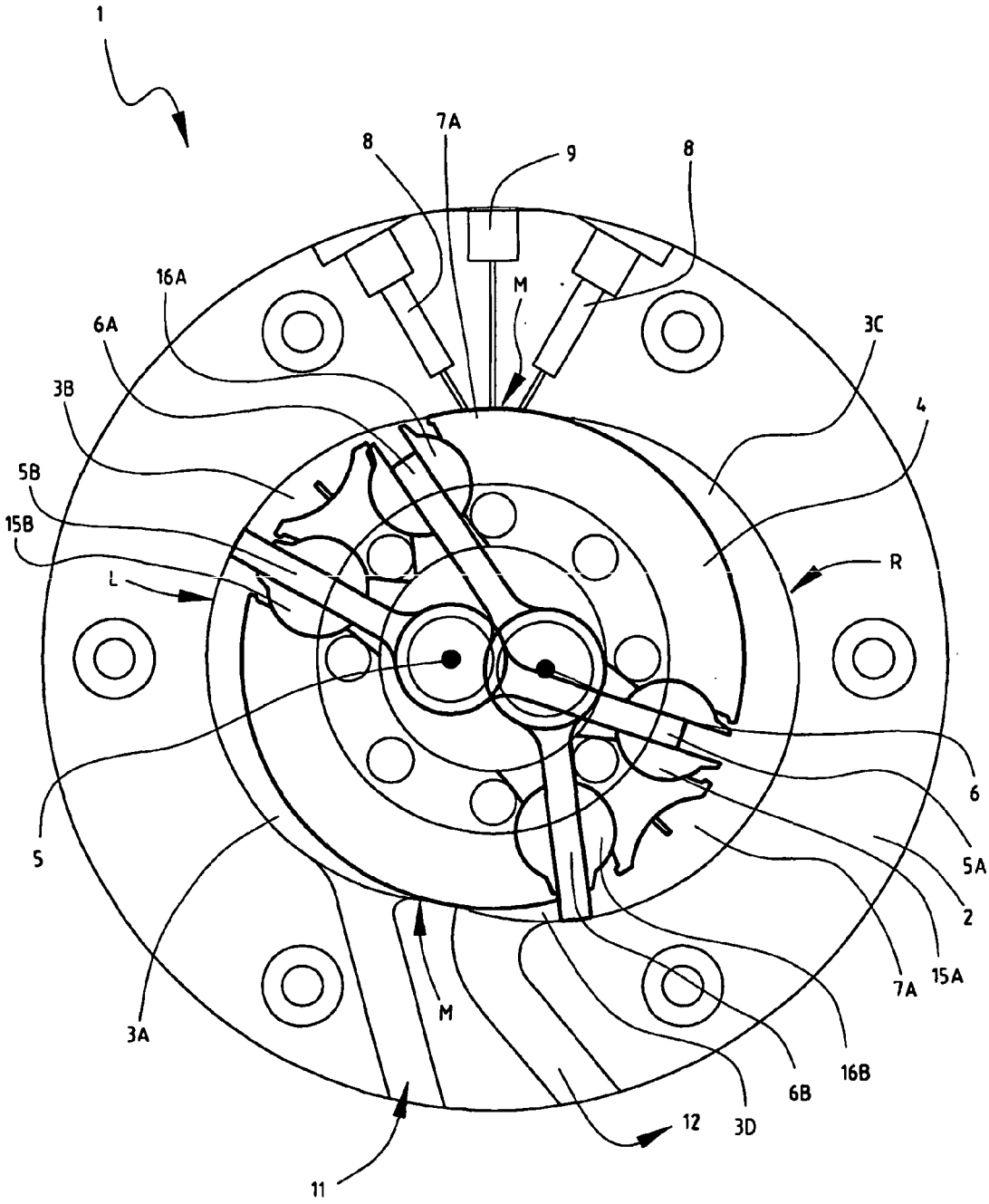
FIG. 3D shows schematically a cross-section through the combustion engine of FIG. 1 in top view, with the rotor in a fourth position.

FIG. 3D shows the rotor in a fourth position, in which the rotor has again been rotated approximately 45 degrees further in clockwise direction. The chamber is still divided into four compartments, 3A–3D respectively. The volume of compartment 3A increases further by air being drawn in by means of intake 11. The air present in compartment 3B is further compressed. In compartment 3C expansion still takes place after combustion and work is still produced. The last combustion gases left in compartment 3D are discharged by means of exhaust 12.

Figure 4:
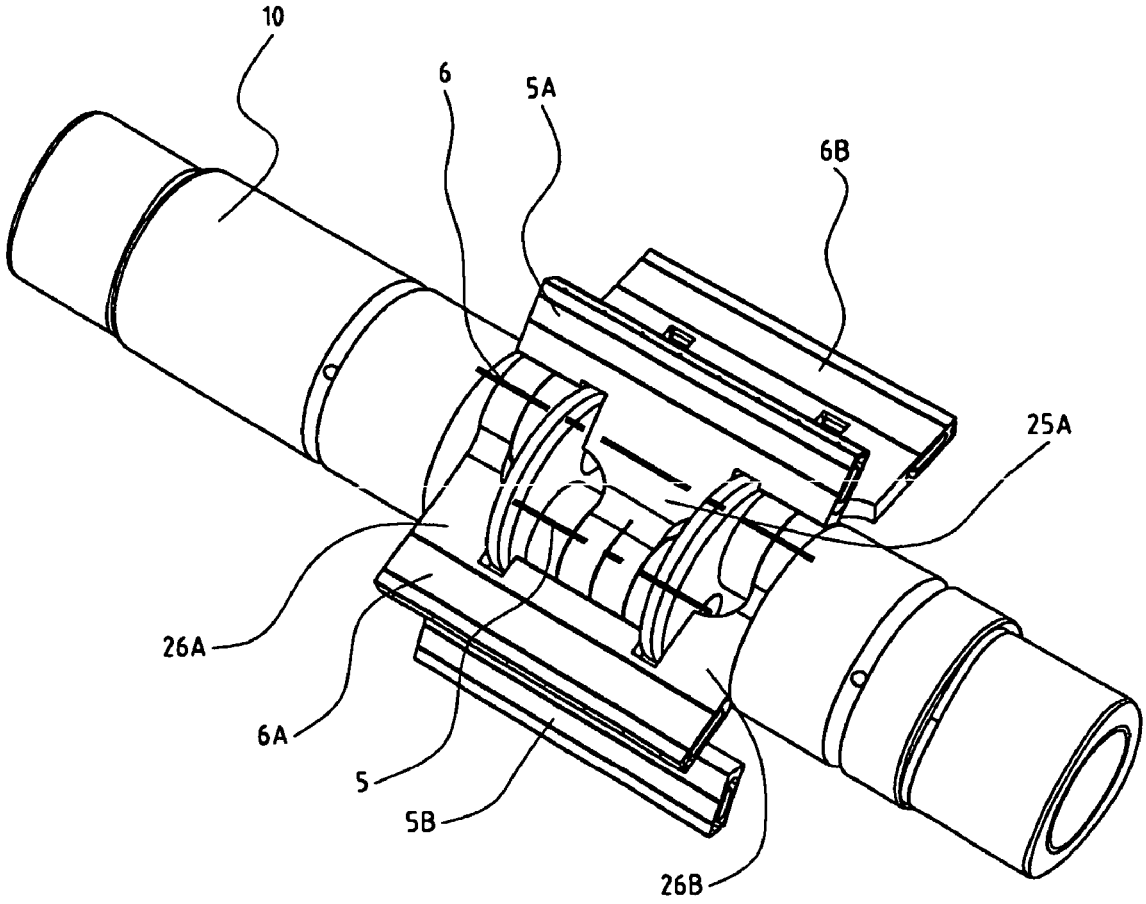
FIG. 4 shows schematically a cross-section through a part of the combustion engine of FIG. 1 in perspective view.

FIG. 4 shows a schematic cross-section through a part of the combustion engine of FIG. 1 in side view. Rotation axes 5 and 6, on which are mounted the vanes (5A, 5B) and (6A, 6B), run through shaft 10. Each of the vanes in the first pair (5A, 5B) is provided with a substantially centrally situated, protruding portion for mounting on rotation axis 5. Protruding portion 25A of vane 5A is shown by way of illustration in FIG. 4. Vane 5B is provided with a similar protruding portion. Each of the vanes in the second pair (6A, 6B) is provided with a substantially centrally situated recess with a protruding portion on both sides for mounting on rotation axis 6. Shown in FIG. 4 are only protruding portions 26A and 26B of vane 6A with a recess therebetween. Vane 6B has a similar construction. All protruding portions are provided with suitable bearings, such as slide bearings.

Summing up, the volumes of compartments 3A–3D change cyclically due to rotation of the rotor 4. These volume changes are analogous to the volume changes of a piston in the known Otto engine and have the same function, i.e. cyclical realization of an intake stroke, a compression stroke, a power stroke and an exhaust stroke. In the combustion engine according to the invention combustion takes place twice per rotation and work is produced twice per rotation. The preparations for bringing about fuel combustion again, i.e. drawing in and compressing the required gases, generally take place in the left-hand part (L) of chamber 3, while the most recent combustion is dealt with by means of power transfer and the exhausting of combustion gases in the right-hand part (R).

In the rotary engine according to the invention only air is drawn in. The indrawn air is first compressed to the maximum. The fuel is then injected separately into one or more of the recesses/compartments 7. The recesses have a relatively very small volume, so that relatively very little time is required to fill each recess with fuel and to cause complete combustion of the resulting mixture. At the moment of injection, the recesses are almost completely separated from each other. This is brought about by the form of the recesses and by the position of the recesses at the moment of injection. At the moment of injection the compressed air is heated such that the conditions required for self-ignition are fulfilled, so that the use (and therefore the presence) of an ignition mechanism is no longer necessary. A second preferred embodiment of the rotary engine can therefore be obtained by omitting the ignition mechanism 9 in all the figures. FIG. 5 shows by way of illustration a schematic view of this second preferred embodiment of the combustion engine according to the invention without ignition mechanism. FIG. 5 is otherwise identical to FIG. 1. It is noted that an extra fuel injector 8 can be arranged instead of ignition mechanism 9 for an optimum fuel distribution per recess and an even more rapid and cleaner combustion.

The performance of the rotary engine according to the invention shows a clear improvement relative to the performance of the known four-stroke Otto engine, as is shown in the table below. The following ratios apply at equal power. Doubling of the rotation speed of the rotary engine results in doubling of the required cylinder capacity, volume, weight and production costs for the Otto engine to produce the same power.

| | Rotary engine | Otto engine |
|---|---|---|
| Power | 1 | 1 |
| Rotation speed | 1 . . . 2 | 1 |
| Cylinder capacity | 1 | 4 . . . 8 |
| Volume | 1 | 4 . . . 8 |
| Weight | 1 | 4 . . . 8 |
| Efficiency | 2 | 1 |
| Production costs | 1 | 4 . . . 8 |

It is noted that the rotary engine is described as petrol engine by way of illustration. The rotary engine according to the invention is however also suitable for diesel. Once in use, it is even possible to fill up alternately with different types of fuel (provided the tank is as empty as possible before filling) without structural modifications. The rotary engine is also suitable for application in all types of vehicle. Some examples are cars, motorbikes, mopeds and scooters, but also aeroplanes and ships.

The invention is not therefore limited to the shown and described preferred embodiments, but extends generally to any embodiment which falls within the scope of the appended claims as seen in light of the foregoing description and drawings.

The invention claimed is:

1. A combustion engine (1), comprising a housing (2) with a chamber (3), in which is arranged a rotor (4) which is provided with a number of vanes (5A, 5B, 6A, 6B) which extend in radial direction to the wall of the chamber (3) and which divide the chamber into a number of compartments (3A, 3B, 3C, 3D), wherein each of the compartments is intended for performing at least one of the following functions:

a) drawing in and/or compressing gas required for the combustion;

b) bringing the fuel to combustion;

c) producing work; and d) discharging combustion gases, wherein a first pair of vanes (5A, 5B) rotate in pairs and is mounted rotatably on a first rotation axis (5) and wherein a second pair of vanes (6A, 6B) rotate in pairs and is mounted rotatably on a second rotation axis (6), which rotation axes are arranged eccentrically in the chamber (3), characterized in that the vanes in each pair (5A, 5B; 6A, 6B) are independently rotatable relative to each other.

2. The combustion engine as claimed in claim 1, wherein each of the vanes in the first pair (5A, 5B) is provided with a protruding portion for mounting on the rotation axis (5).

3. The combustion engine as claimed in claim 2, wherein each protruding portion is provided with a bearing which is mounted round the rotation axis.

4. The combustion engine as claimed in claim 1, wherein each of the vanes in the second pair (6A, 6B) is provided with a recess with a protruding portion on either side for mounting on the rotation axis (6).

5. The combustion engine as claimed in claim 1, wherein the chamber is assembled from three cylinders which partly overlap each other and the axes of which run substantially parallel to each other.

6. The combustion engine as claimed in claim 5, wherein the cross-section of a first part of the chamber takes the form of a first circle (L) with the first rotation axis (5) as centre and a radius which is approximately equal to the radial dimensions of the largest of the associated vanes (5A, 5B).

7. The combustion engine as claimed in claim 5, wherein the cross-section of a second part of the chamber takes the form of a second circle (R) with the second rotation axis (6) as centre and a radius which is approximately equal to the radial dimensions of the largest of the associated vanes (6A, 6B).

8. The combustion engine as claimed in claim 5, wherein the cross-section of a third part of the chamber takes the form of a third circle (M).

9. The combustion engine as claimed in claim 5, wherein the cross-section of a first part of the chamber takes the form of a first circle (L) with the first rotation axis (5) as center and a radius which is approximately equal to the radial dimensions of the larges of the associated vanes (5A, 5B) and the cross-section of a second part of the chamber takes the form of a second circle R with the second rotation axis (6) as center and a radius which is approximately equal to the radial dimensions of the largest of the associated vanes (6A, 6B) and the radius of the second circle R is larger than the radius of the first circle.

10. The combustion engine as claimed in claim 1, wherein the rotor has a number of recesses for the purpose of forming a corresponding number of compartments for bringing the fuel to combustion, characterized in that a plurality of recesses (7A, 7B, 7C, 7D; 7E, 7F, 7G, 7H) is arranged on both sides of the rotor (4).

11. The combustion engine as claimed in claim 10, wherein the form of the recesses is cup-shaped.

12. The combustion engine as claimed in claim 10, wherein the form of the recesses is groove-shaped.

13. The combustion engine as claimed in claim 10, wherein the combustion engine is adapted for injection of fuel directly into the recesses.

14. The combustion engine as claimed in claim 10, wherein the combustion engine is adapted to control the engine power by varying the number of recesses to be injected with fuel.

15. The combustion engine as claimed in claim 10, characterized in that the combustion engine requires no ignition mechanism for the fuel.

16. The combustion engine as claimed in claim 10, wherein the cross-section of a first part of the chamber takes the form of a first circle (L) with the first rotation axis (5) as center and a radius which is approximately equal to the radial dimensions of the larges of the associated vanes (5A, 5B) and the cross-section of a second part of the chamber takes the form of a second circle R with the second rotation axis (6) as center and a radius which is approximately equal to the radial dimensions of the largest of the associated vanes (6A, 6B) and the radius of the second circle R is larger than the radius of the first circle (L).

* * * * *